US009069290B2

(12) United States Patent
Massaro, Jr.

(10) Patent No.: US 9,069,290 B2
(45) Date of Patent: Jun. 30, 2015

(54) METHOD FOR REMANUFACTURING TONER CARTRIDGES

(71) Applicant: Peter Vincent Massaro, Jr., West Haven, CT (US)

(72) Inventor: Peter Vincent Massaro, Jr., West Haven, CT (US)

(73) Assignee: FLO-TECH, LLC, Middletown, CT (US)

( * ) Notice: Subject to any disclaimer, the term of this patent is extended or adjusted under 35 U.S.C. 154(b) by 0 days.

(21) Appl. No.: 14/230,724

(22) Filed: Mar. 31, 2014

(65) Prior Publication Data

US 2014/0314442 A1 Oct. 23, 2014

Related U.S. Application Data

(60) Provisional application No. 61/814,996, filed on Apr. 23, 2013.

(51) Int. Cl.
*G03G 15/00* (2006.01)
*G03G 15/08* (2006.01)

(52) U.S. Cl.
CPC ..... *G03G 15/0894* (2013.01); *G03G 15/0865* (2013.01)

(58) Field of Classification Search
CPC ..... G03G 21/181; G03G 21/1647; G03G 2215/00987; G03G 15/0894; G03G 15/0865
USPC ..... 399/109
See application file for complete search history.

(56) References Cited

U.S. PATENT DOCUMENTS

| | | | | |
|---|---|---|---|---|
| 5,870,654 | A * | 2/1999 | Sato et al. | 399/109 |
| 6,115,570 | A * | 9/2000 | Kilian et al. | 399/111 |
| 2011/0268470 | A1 * | 11/2011 | Holmes et al. | 399/109 |

* cited by examiner

*Primary Examiner* — Walter L Lindsay, Jr.
*Assistant Examiner* — Jessica L Eley
(74) *Attorney, Agent, or Firm* — Bachman & LaPointe, P.C.

(57) ABSTRACT

A method for remanufacturing toner cartridges includes the use of a plurality of machine screw inserts. Each of a plurality of screw holes of a toner cartridge shell is tapped to create new threading within the plurality of screw holes. The plurality of machine screw inserts is positioned into the plurality of screw holes in order to reinforce the plurality of screw holes, wherein each of the plurality of machine screw inserts has a threaded outer surface and a threaded inner surface. The plurality of machine screw inserts provides a durable interface with a plurality of screws that reduces the chance of failure of the plurality of screws as the plurality of screws is positioned within the plurality of screw holes. An adhesive is applied to each of the plurality of machine screw inserts in order to secure the plurality of machine screw inserts within the plurality of screw holes.

20 Claims, 11 Drawing Sheets

METHOD FOR REMANUFACTURING TONER CARTRIDGES

The current application claims a priority to the U.S. Provisional Patent application Ser. No. 61/814,996 filed on Apr. 23, 2013.

FIELD OF THE INVENTION

The present invention relates generally to laser printer. More specifically, the present invention is a method for remanufacturing empty laser printer toner cartridges that eliminates stripped plastic screw holes causing cartridge damage.

BACKGROUND OF THE INVENTION

The consumable component of modern xerographic laser printers is the toner cartridge. Toner cartridges are similar to ink cartridges used by inkjet printers but contain toner powder that is used to form images on paper. During the printing process, the photoreceptor of the laser printer is positively charged and an electrostatic image is formed on the surface of the photoreceptor. The electrostatic image is formed by discharging portions of the photoreceptor surface to form the image. These portions of the photoreceptor surface are negatively discharged. The toner powder is electrostatically drawn from the cartridge and transferred to paper. Because the toner powder features a positive charge, the particles are drawn to the negatively discharged portions of the photoreceptor, forming a toner image on the photoreceptor surface. The toner powder is repelled from the positively charged portions of the photoreceptor. Following the application of the toner powder, the photoreceptor drum is rolled over a sheet of paper. The sheet of paper is given a negative charge that is stronger than the negative charge of the photoreceptor drum. This allows the toner powder to transfer from the photoreceptor drum to the paper. The toner powder is finally heated, melted, and rolled onto the paper by the fuser.

Toner cartridges are typically very expensive which has led to the emergence of an industry for remanufactured toner cartridges. Remanufactured toner cartridges are recycled original toner cartridges that have undergone a number of quality control processes. Used toner cartridges are disassembled and cleaned before the toner hopper is refilled with toner powder. The toner hopper is sealed to prevent the toner cartridge from leaking during use. The toner cartridge is reassembled following the cleaning, refilling, and sealing processes. A common problem of remanufactured toner cartridges is stripped plastic in threaded screw holes. Repeated disassembly and reassembly of the toner cartridges results in stripped threading in the screw holes. The problem is exacerbated by the vibrations experienced by the toner cartridges during use. Unreliable fasteners can lead to problems with the toner cartridge and the laser printer as well. The present invention seeks to address the aforementioned issue and provide a practical, reliable, and repeatable solution.

Therefore it is the object of the present invention to provide a method for remanufacturing empty laser printer toner cartridges that eliminates stripped plastic screw holes commonly encountered during the remanufacturing process and during use. In the preferred embodiment of the present invention, a machine screw insert is slotted into all plastic screw holes of a toner cartridge hopper shell and waste bin shell. The machine screw is attached to a mandrel and inserted into a hole that is threaded by a tap. Each machine screw insert is adhesively held in place within a plastic screw hole. This allows machine screws to be used during the toner cartridge reassembly process without stripping the plastic threading of the screw holes. After the machine screw inserts have been installed, the toner cartridges may be reliably remanufactured multiple times.

DETAIL DESCRIPTIONS OF THE INVENTION

All illustrations of the drawings are for the purpose of describing selected versions of the present invention and are not intended to limit the scope of the present invention.

The present invention is a method for remanufacturing empty laser printer toner cartridges that maintains the structural integrity of the screw holes used when disassembling and reassembling the cartridges. In the preferred embodiment of the present invention, a plurality of machine screw inserts 40 is slotted into a plurality of screw holes 12 of a toner cartridge shell 11 in order to prevent damage to the plurality of screw holes 12 from repeated disassembly and reassembly of a toner cartridge 10.

Figure 3:
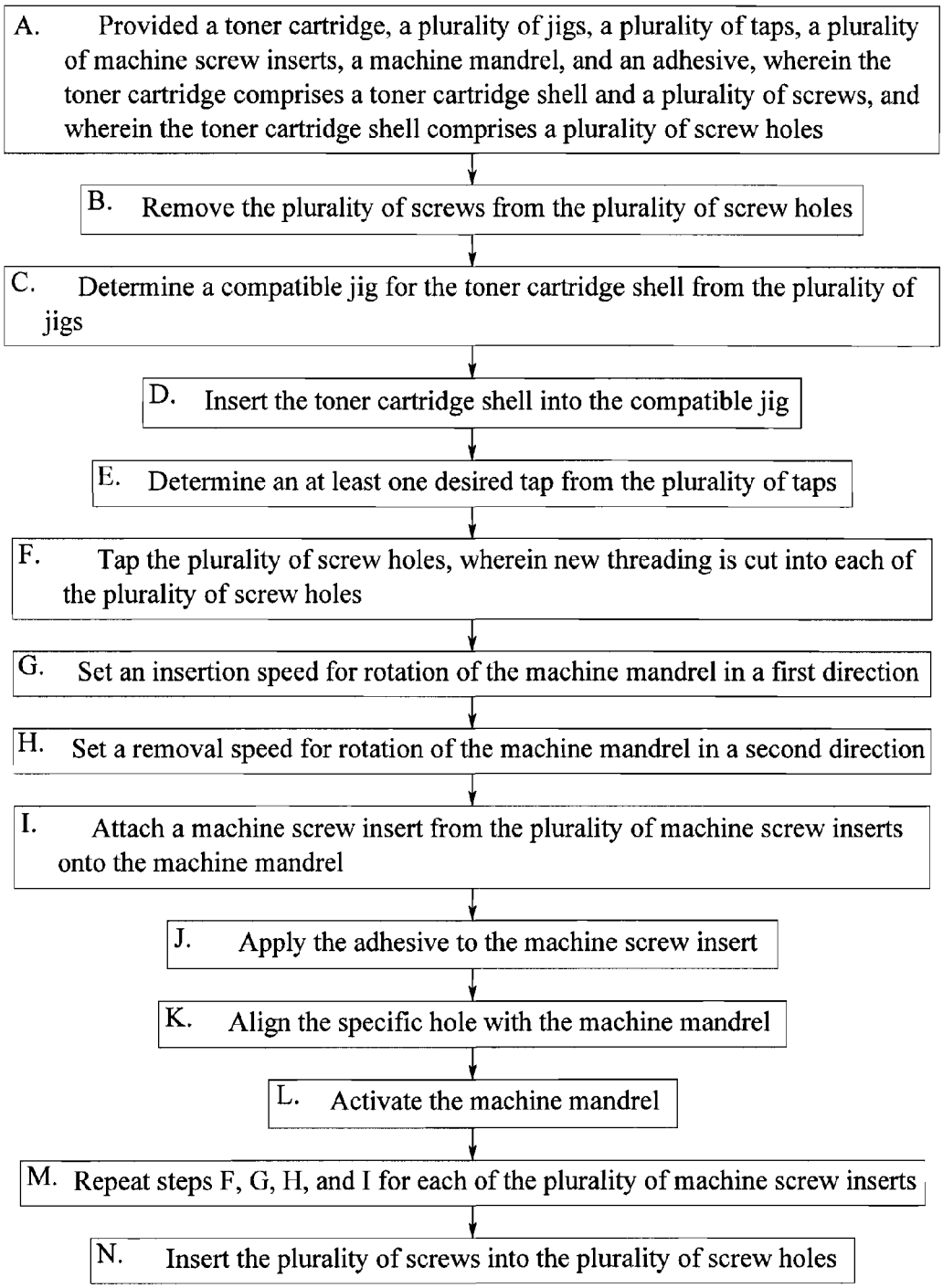
FIG. 3 is a flowchart including additional steps for carrying out the method of the present invention.
Figure 4:
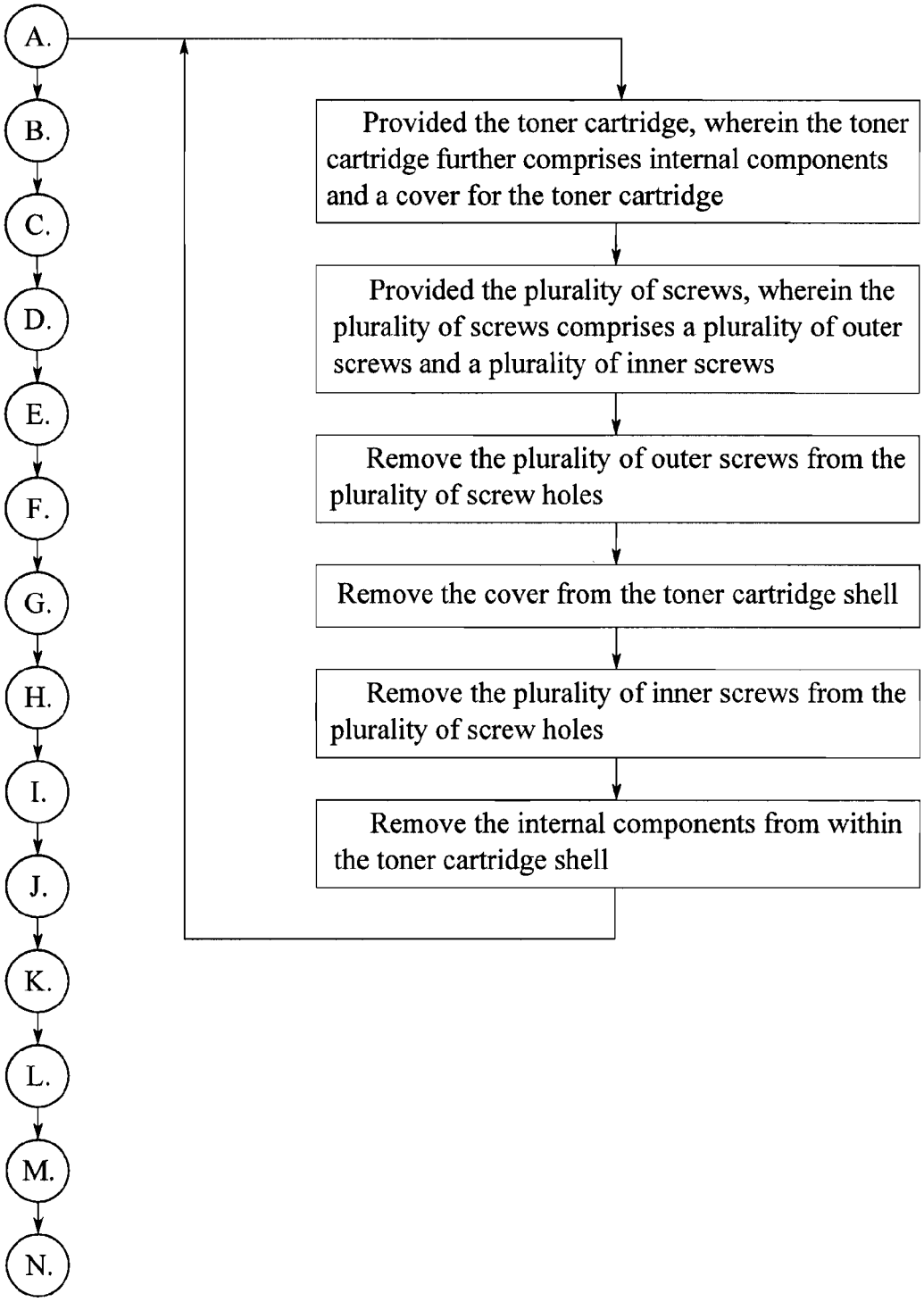
FIG. 4 is a flowchart thereof expanding on the step of removing the plurality of screws from the plurality of screw holes in order to disassemble the toner cartridge.

In reference to FIG. 3-4, in order to install the plurality of machine screw inserts 40, the toner cartridge 10, comprising the toner cartridge shell 11, a cover 18, internal components 17, and a plurality of screws 14, must first be disassembled. The plurality of screws 14 is removed from the plurality of screw holes 12 in order to disassemble the toner cartridge 10. The plurality of screws 14 comprises a plurality of outer screws 15 and a plurality of inner screws 16. The plurality of outer screws 15 is removed from the plurality of screw holes 12, such that the cover 18 can then be removed from the toner cartridge shell 11. Once the cover 18 is removed, the plurality of inner screws 16 retaining the internal components 17 within the toner cartridge shell 11 is removed from the plurality of screw holes 12. Each of the internal components 17 is then removed from the toner cartridge shell 11. The internal components 17 may comprise any known toner cartridge 10 components, such as a primary charge roller, a drum, a wiper blade, a toner roller, etc. The toner cartridge shell 11 is then cleaned following removal of the internal components 17.

Figure 1:
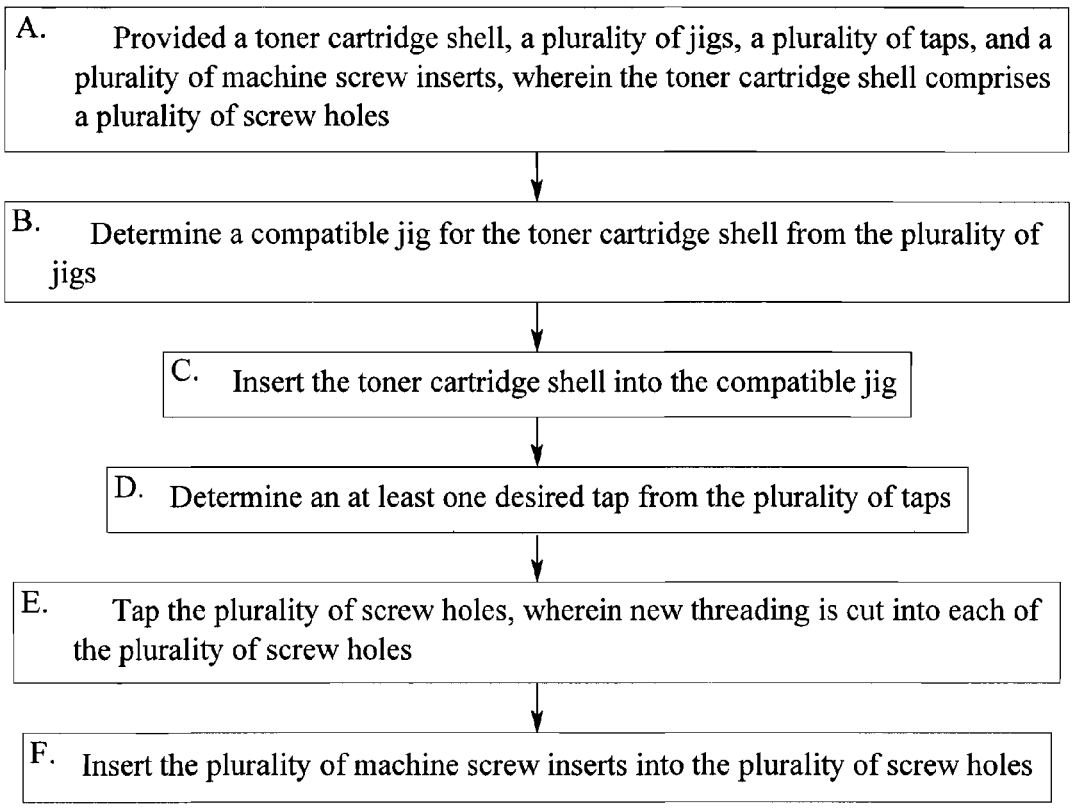
FIG. 1 is a flowchart showing the basic steps for carrying out the method of the present invention.
Figure 6:
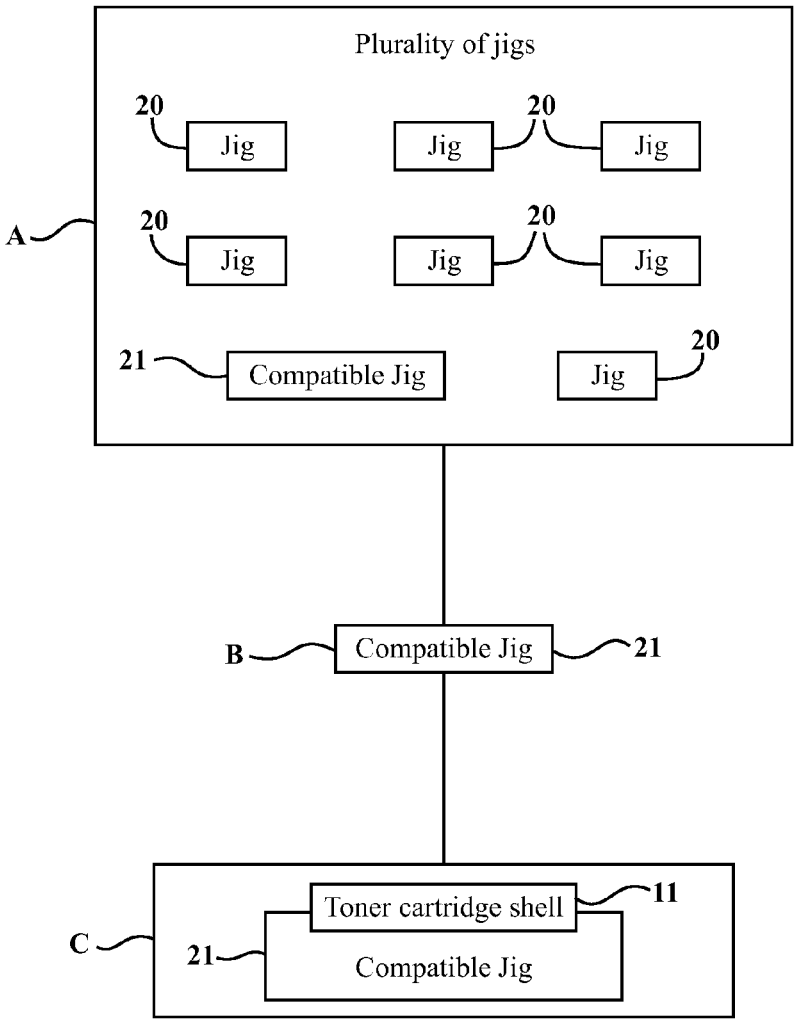
FIG. 6 is a diagram depicting part of step A and steps B and C of FIG. 1, namely the selection of the compatible jig from the plurality of jigs, and the insertion of the toner cartridge shell into the compatible jig.
Figure 7:
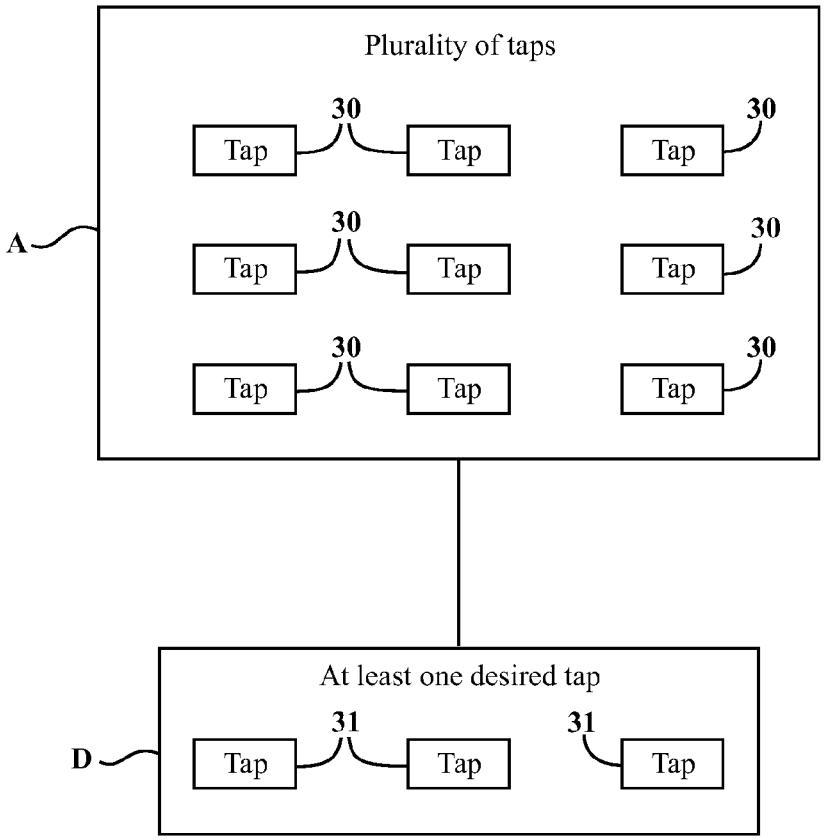
FIG. 7 is a diagram depicting part of step A and step D of FIG. 1, namely the selection of the at least one desired tap from the plurality of taps.

In reference to FIG. 1 and FIG. 6, in order to carry out the method of the present invention, a plurality of jigs 20 is provided in order to accommodate different models of the toner cartridge 10. By observing the model of the toner cartridge 10, a compatible jig 21 for the toner cartridge shell 11 is determined from the plurality of jigs 20. The compatible jig 21 acts to hold the toner cartridge shell 11 in place, while allowing the toner cartridge shell 11 to be aligned with a machine drill, such that the plurality of screw holes 12 can be accurately drilled. In reference to FIG. 7, a plurality of taps 30 is also provided in order to accommodate for various diameters in the plurality of screw holes 12. From observing the plurality of screw holes 12 of the toner cartridge shell 11, at least one desired tap 31 is determined from the plurality of taps 30.

Once the at least one tap is selected, the at least one tap is attached to the machine drill. Each of the plurality of screw holes 12 is then tapped using the machine drill, wherein the at least one tap is lowered into each of the plurality of screw holes 12 in order to create new threading within each of the plurality of screw holes 12. The drilling machine depth is preset according to the compatible jig 21 and the plurality of screw holes 12. In the preferred embodiment of the present invention, the drilling machine is operated at a rotation speed between 300 and 500 revolutions per minute. Additionally, the drilling machine is operated at a low torque in order to ensure that the each of the plurality of screw holes 12 is correctly tapped. In the preferred embodiment of the present invention, the drilling machine is operated in a torque range of 1.5 to 6.5 Newton meters.

If there are multiple diameters amongst the plurality of screw holes 12, then the at least one tap comprises a first tap and at least one subsequent tap. The first tap is attached to the machine drill and used to tap the plurality of screw holes 12 having a first diameter. Each of the at least one subsequent tap is then attached to the machine drill and used to tap the plurality of screw holes 12 having a second diameter, third diameter, etc.

Figure 8:
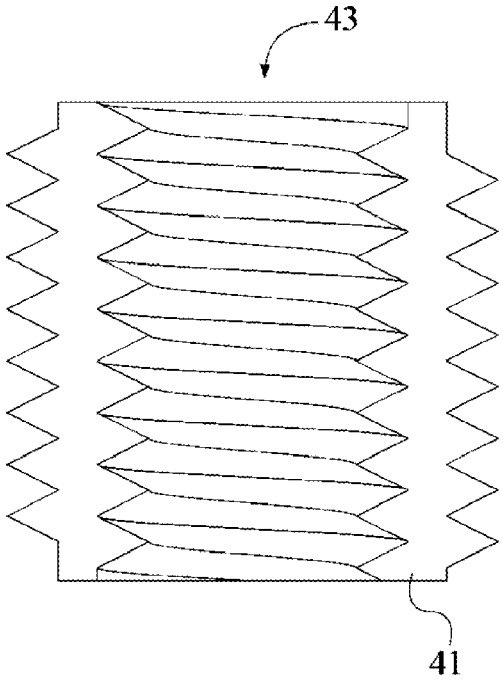
FIG. 8 is a front sectional view of a machine screw insert.
Figure 9:
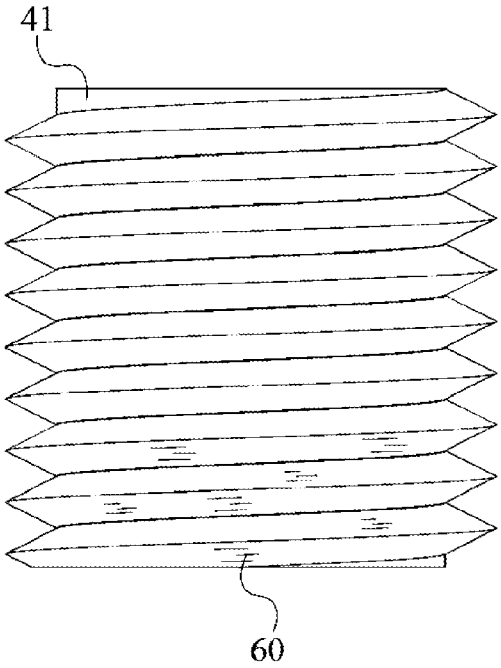
FIG. 9 is a front elevational view thereof showing the adhesive applied to the machine screw insert.

After each of the plurality of screw holes 12 has been tapped, the plurality of machine screw inserts 40 can be inserted into the plurality of screw holes 12. In reference to FIG. 8-9, each of the plurality of machine screw inserts 40 is a tubular extrusion having a threaded outer surface 42 and a threaded inner surface 43. The threaded outer surface 42 is designed to interface with the new threading in the plurality of screw holes 12, while the threaded inner surface 43 is designed to interface with the plurality of screws 14. In the preferred embodiment of the present invention, each of the plurality of machine screw inserts 40 is constructed from metal, however, it is possible for the plurality of machine screw inserts 40 to be constructed from any other durable material.

Figure 2:
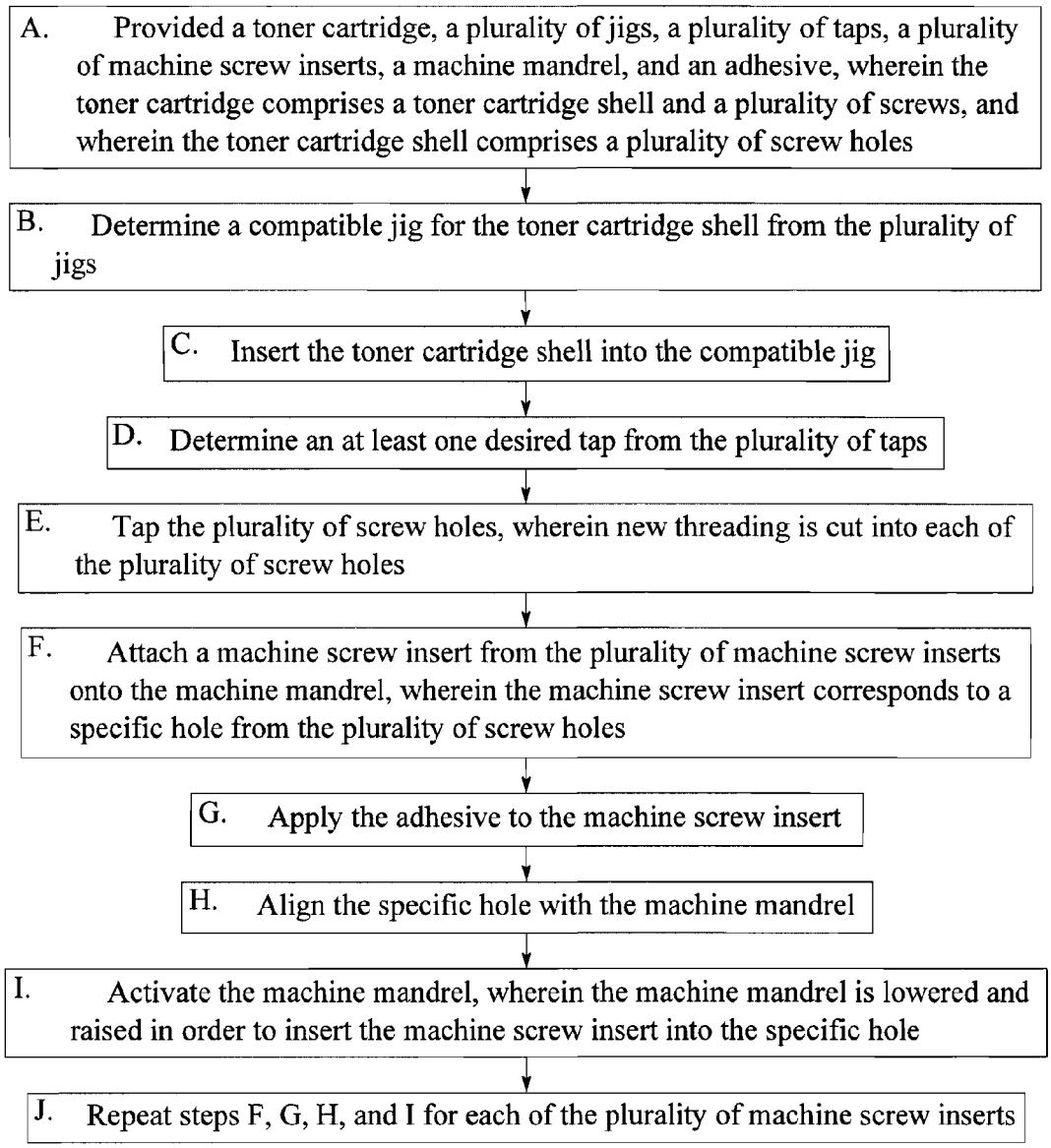
FIG. 2 is a flowchart thereof showing expanded steps for inserting the plurality of machine screw inserts into the plurality of screw holes.
Figure 10:
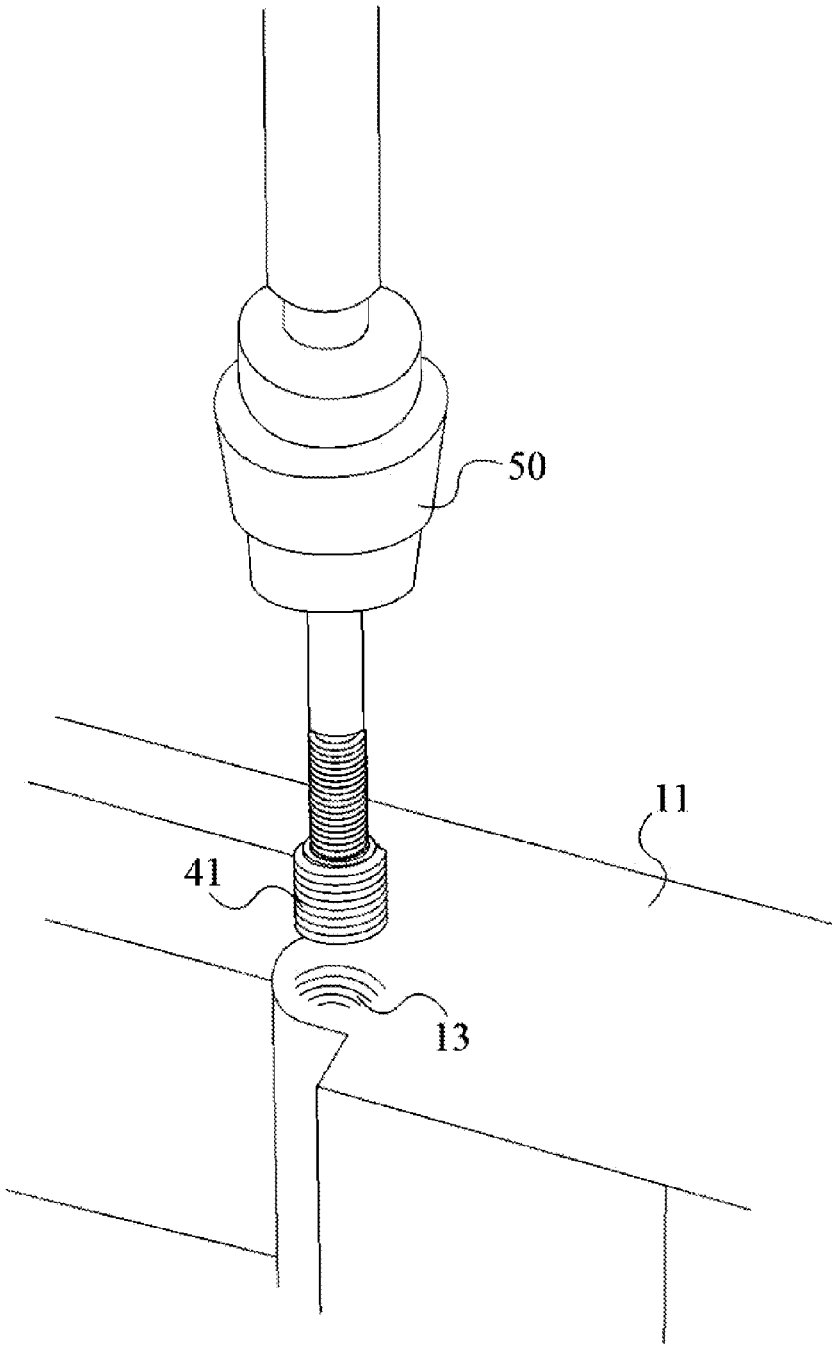
FIG. 10 is a diagram depicting a specific hole being aligned with the machine mandrel.
Figure 11:
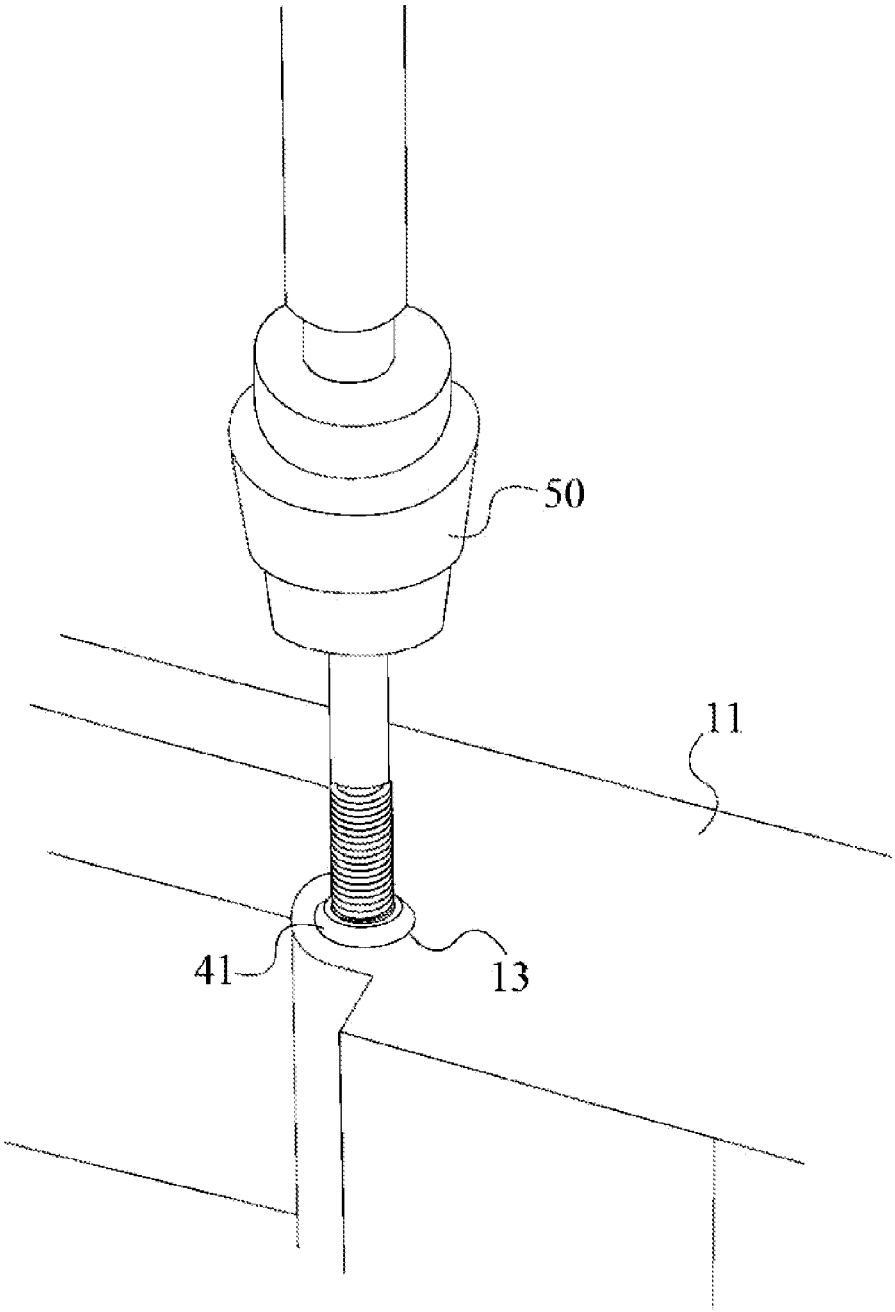
FIG. 11 is a diagram depicting the machine screw insert being inserted into the specific hole 13, wherein the machine mandrel is spun in a first direction.

In order to insert the plurality of machine screw inserts 40, a machine mandrel 50 is provided and attached to the drilling machine. In reference to FIG. 2 and FIG. 10, a machine screw insert 41 is selected from the plurality of machine screw inserts 40 and attached to the machine mandrel 50, wherein the machine screw insert 41 corresponds to a specific hole 13 from the plurality of screw holes 12. An adhesive 60 is then applied to the machine screw insert 41, and the specific hole 13 is aligned with the machine mandrel 50. The machine mandrel 50 is then activated and the machine screw insert 41 is inserted into the specific hole 13, as shown in FIG. 11, wherein the threaded outer surface 42 of the machine screw insert 41 engages the new threading of the specific hole 13 in order to retain the machine screw insert 41 within the specific hole 13. The adhesive 60 acts to further secure the machine screw insert 41 within the specific hole 13 once the adhesive 60 is provided time to dry.

Figure 12:
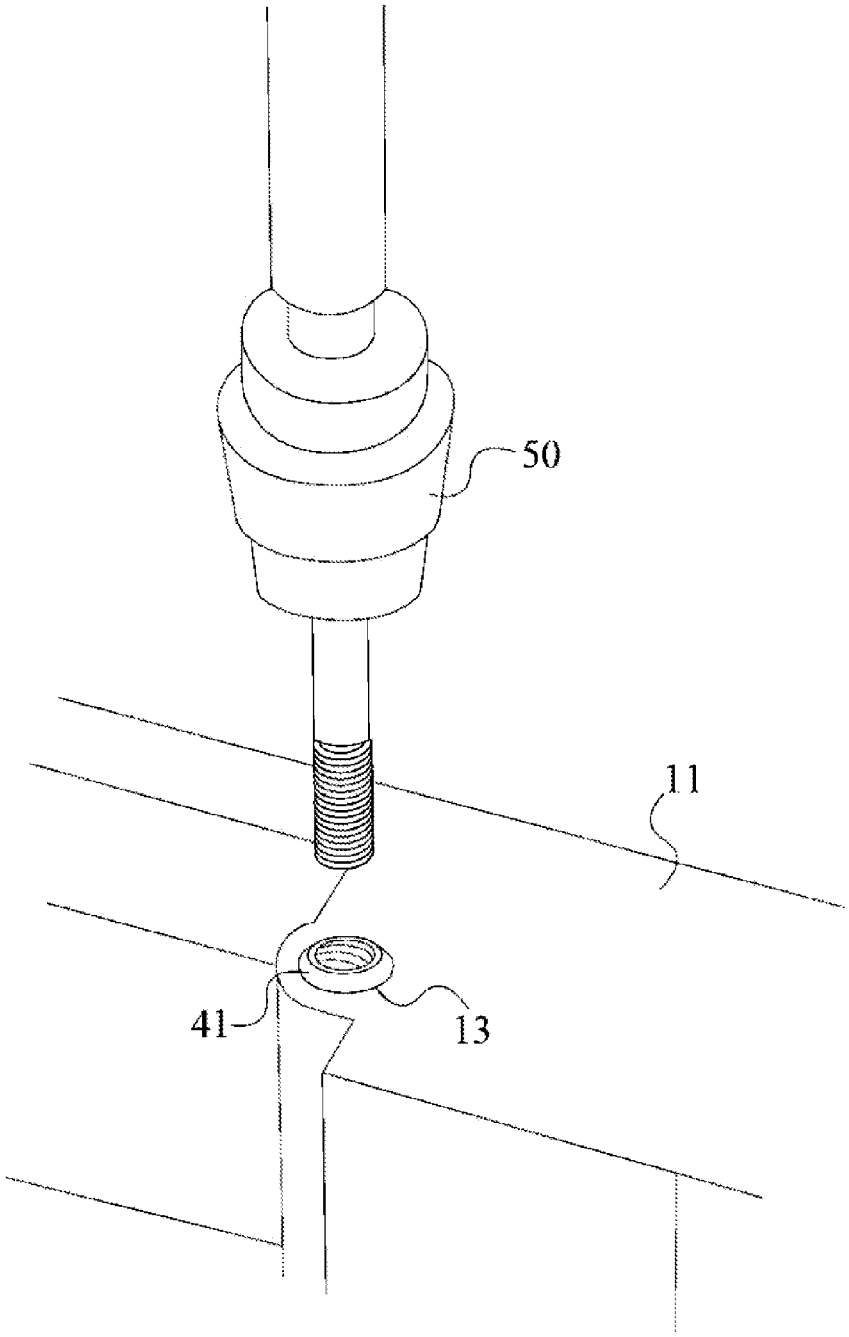
FIG. 12 is a diagram depicting the machine mandrel being raised while spun in a second direction, and the machine screw insert being secured within the specific hole.

When the machine mandrel 50 is activated, the machine mandrel 50 is spun in a first direction in order to insert the machine screw insert 41 into the specific hole 13. The machine mandrel 50 is then lowered into the screw hole, wherein the machine screw insert 41 is inserted into the specific hole 13, as shown in FIG. 11. Upon reaching the depth of the specific hole 13, the machine mandrel 50 is stopped and then spun in a second direction opposite the first direction. As the machine mandrel 50 is spun in the second direction, the machine mandrel 50 is raised out of the specific hole 13, wherein the machine screw insert 41 is retained within the specific hole 13, as shown in FIG. 12.

In reference to FIG. 3, both an insertion speed and a removal speed for spinning the machine mandrel 50 in the first direction and the second direction, respectively, are set into the drilling machine before the plurality of machine screw inserts 40 is attached to the machine mandrel 50. In the preferred embodiment of the present invention, the insertion speed is less than 300 revolutions per minute, while the removal speed is approximately half that of the insertion speed. Additionally, the machine mandrel 50 is spun in both the first direction and the second direction at low torque in order to ensure that the machine screw is properly engaged with and secured in the specific hole 13.

Figure 5:
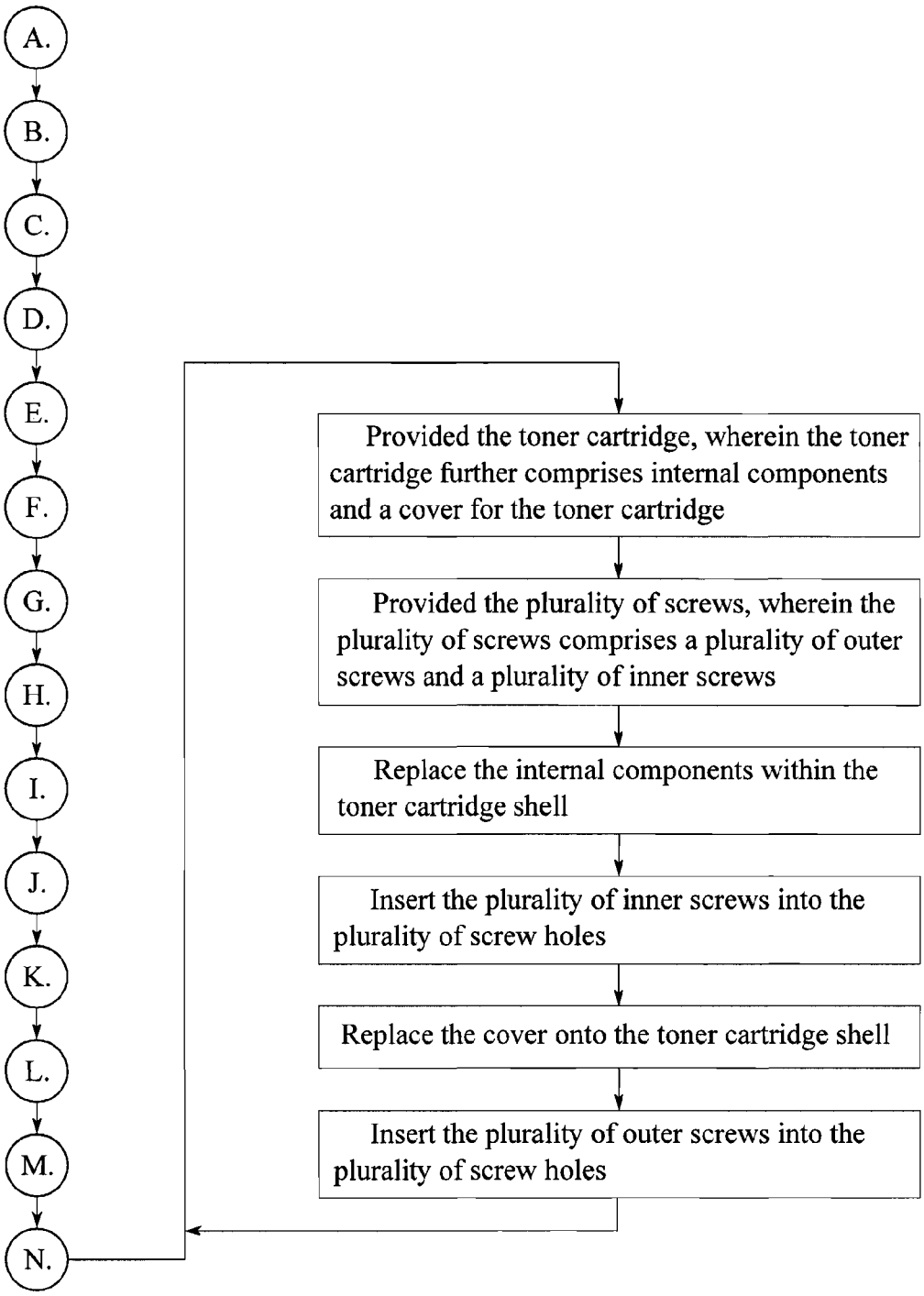
FIG. 5 is a flowchart thereof expanding on the step of inserting the plurality of screws into the plurality of screw holes in order to reassemble the toner cartridge.

The steps described above for inserting the machine screw insert 41 into the specific hole 13 are then repeated for each of the plurality of machine screw inserts 40 until the plurality of screw holes 12 has been retrofitted. In reference to FIG. 3 and FIG. 5, once each of the plurality of machine screw inserts 40 has been installed, the toner cartridge 10 can be reassembled. Each of the internal components 17 is replaced within the toner cartridge shell 11 and the plurality of inner screws 16 is inserted into the plurality of screw holes 12, wherein the plurality of inner screws 16 engages the plurality of machine screws. The toner cartridge shell 11 is then filled with new toner, the cover 18 is replaced onto the toner cartridge shell 11, and the plurality of outer screws 15 is inserted into the plurality of screw holes 12, wherein the plurality of outer screws 15 engages the plurality of machine screws.

It is an object of the present invention to provide a method of remanufacturing used laser printer toner cartridges without compromising the quality and structural integrity of the toner cartridges themselves. As each of the plurality of screws 14 of a toner cartridge 10 is removed and reinstalled during the disassembly and reassembly processes of remanufacturing, the plurality of screw holes 12 of the toner cartridge shell 11 that has been remanufactured multiple times typically becomes worn as the old plastic threading is stripped. The stripped screw holes result in unreliable fasteners that can potentially lead to problems with both the toner cartridge 10 and the laser printer. The plurality of machine screw inserts 40 of the present invention serve as protective supports for the plurality of screw holes 12 that retains the plurality of screws 14, without stripping the threading from the plurality of screw holes 12. This allows laser printer toner cartridges to be reused multiple times while maintaining the overall quality of the cartridges and avoiding issues resulting from stripped screw holes. In addition to improving reliability of the fasteners used to assemble the toner cartridges, the present invention reduces the potential for the toner cartridge 10 to cause hardware problems for the laser printer. It is a further object of the present invention to minimize financial costs related to purchasing laser printer toner cartridges. It is generally known that remanufacturing the toner cartridge 10 when empty is a much more cost effective option than purchasing a brand new toner cartridge. Additionally, by reducing the likelihood of the toner cartridge 10 causing hardware problems for a laser printer, potential maintenance and repair costs are lowered as well. Empty toner cartridges are often improperly discarded resulting in environmental ramifications. Improving the overall laser printer toner cartridge remanufacturing process serves as a further incentive to remanufacture empty cartridges.

Although the invention has been explained in relation to its preferred embodiment, it is to be understood that many other possible modifications and variations can be made without departing from the spirit and scope of the invention as hereinafter claimed.

What is claimed is:

1. A method for remanufacturing toner cartridges comprises the steps of:

A. providing a toner cartridge shell, a plurality of jigs, a plurality of taps, and a plurality of machine screw inserts, wherein the toner cartridge shell comprises a plurality of screw holes;

B. determining a compatible jig for the toner cartridge shell from the plurality of jigs;

C. inserting the toner cartridge shell into the compatible jig;

D. determining an at least one desired tap from the plurality of taps;

E. tapping the plurality of screw holes, wherein new threading is cut into each of the plurality of screw holes; and F. inserting the plurality of machine screw inserts into the plurality of screw holes.

2. The method for remanufacturing toner cartridges as claimed in claim 1 further comprises the steps of:

providing a toner cartridge, wherein the toner cartridge comprises the toner cartridge shell and a plurality of screws; and removing the plurality of screws from the plurality of screw holes.

3. The method for remanufacturing toner cartridges as claimed in claim 2 further comprises the steps of:

providing the toner cartridge, wherein the toner cartridge further comprises internal components and a cover;

providing the plurality of screws, wherein the plurality of screws comprises a plurality of outer screws and a plurality of inner screws;

removing the plurality of outer screws from the plurality of screw holes;

removing the cover from the toner cartridge shell;

removing the plurality of inner screws from the plurality of screw holes; and removing the internal components from within the toner cartridge shell.

4. The method for remanufacturing toner cartridges as claimed in claim 1 further comprises the steps of:

providing a toner cartridge, wherein the toner cartridge comprises the toner cartridge shell and a plurality of screws; and inserting the plurality of screws into the plurality of screw holes, wherein the plurality of screws engages the plurality of machine screw inserts.

5. The method for remanufacturing toner cartridges as claimed in claim 4 further comprises the steps of:

providing the toner cartridge, wherein the toner cartridge further comprises internal components and a cover;

providing the plurality of screws, wherein the plurality of screws comprises a plurality of outer screws and a plurality of inner screws;

replacing the internal components within the toner cartridge shell;

inserting the plurality of inner screws into the plurality of screw holes, wherein the plurality of inner screws engages the plurality of machine screw inserts;

replacing the cover onto the toner cartridge shell; and inserting the plurality of outer screws into the plurality of screw holes, wherein the plurality of outer screws engages the plurality of machine screw inserts.

6. The method for remanufacturing toner cartridges as claimed in claim 1 further comprises the steps of:

providing a machine mandrel;

attaching a machine screw insert from the plurality of machine screw inserts onto the machine mandrel;

aligning a specific hole from the plurality of screw holes with the machine mandrel; and activating the machine mandrel, wherein the machine mandrel is lowered and raised in order to insert the machine screw insert into the specific hole.

7. The method for remanufacturing toner cartridges as claimed in claim 6 further comprises the steps of:

setting an insertion speed for rotation of the machine mandrel in a first direction, wherein the machine mandrel is spun in the first direction as the machine mandrel is lowered; and setting a removal speed for rotation of the machine mandrel in a second direction, wherein the machine mandrel is spun in the second direction as the machine mandrel is raised.

8. The method for remanufacturing toner cartridges as claimed in claim 7, wherein the insertion speed is less than 300 revolutions per minute and the removal speed is approximately half the insertion speed.

9. The method for remanufacturing toner cartridges as claimed in claim 1 further comprises the steps of:

providing an adhesive; and applying the adhesive to the plurality of machine screw inserts.

10. A method for remanufacturing toner cartridges comprises the steps of:

A. providing a toner cartridge, a plurality of jigs, a plurality of taps, a plurality of machine screw inserts, a machine mandrel, and an adhesive, wherein the toner cartridge comprises a toner cartridge shell and a plurality of screws, and wherein the toner cartridge shell comprises a plurality of screw holes;

B. determining a compatible jig for the toner cartridge shell from the plurality of jigs;

C. inserting the toner cartridge shell into the compatible jig;

D. determining an at least one desired tap from the plurality of taps;

E. tapping the plurality of screw holes, wherein new threading is cut into each of the plurality of screw holes;

F. attaching a machine screw insert from the plurality of machine screw inserts onto the machine mandrel, wherein the machine screw insert corresponds to a specific hole from the plurality of screw holes;

G. applying the adhesive to the machine screw insert;

H. aligning the specific hole with the machine mandrel;

I. activating the machine mandrel, wherein the machine mandrel is lowered and raised in order to insert the machine screw insert into the specific hole; and J. repeating steps F, G, H, and I for each of the plurality of machine screw inserts.

11. The method for remanufacturing toner cartridges as claimed in claim 10 further comprises the steps of:

providing a toner cartridge, wherein the toner cartridge comprises the toner cartridge shell and a plurality of screws; and removing the plurality of screws from the plurality of screw holes.

12. The method for remanufacturing toner cartridges as claimed in claim 11 further comprises the steps of:

providing the toner cartridge, wherein the toner cartridge further comprises internal components and a cover;

providing the plurality of screws, wherein the plurality of screws comprises a plurality of outer screws and a plurality of inner screws;

removing the plurality of outer screws from the plurality of screw holes;

removing the cover from the toner cartridge shell;

removing the plurality of inner screws from the plurality of screw holes; and removing the internal components from within the toner cartridge shell.

13. The method for remanufacturing toner cartridges as claimed in claim 10 further comprises the steps of:

providing a toner cartridge, wherein the toner cartridge comprises the toner cartridge shell and a plurality of screws; and inserting the plurality of screws into the plurality of screw holes, wherein the plurality of screws engages the plurality of machine screw inserts.

14. The method for remanufacturing toner cartridges as claimed in claim 13 further comprises the steps of:

providing the toner cartridge, wherein the toner cartridge further comprises internal components and a cover;

providing the plurality of screws, wherein the plurality of screws comprises a plurality of outer screws and a plurality of inner screws;

replacing the internal components within the toner cartridge shell;

inserting the plurality of inner screws into the plurality of screw holes, wherein the plurality of inner screws engages the plurality of machine screw inserts;

replacing the cover onto the toner cartridge shell; and inserting the plurality of outer screws into the plurality of screw holes, wherein the plurality of outer screws engages the plurality of machine screw inserts.

15. The method for remanufacturing toner cartridges as claimed in claim 10 further comprises the steps of:

setting an insertion speed for rotation of the machine mandrel in a first direction, wherein the machine mandrel is spun in the first direction as the machine mandrel is lowered; and setting a removal speed for rotation of the machine mandrel in a second direction, wherein the machine mandrel is spun in the second direction as the machine mandrel is raised.

16. The method for remanufacturing toner cartridges as claimed in claim 15, wherein the insertion speed is less than 300 revolutions per minute and the removal speed is approximately half the insertion speed.

17. A method for remanufacturing toner cartridges comprises the steps of:

A. providing a toner cartridge, a plurality of jigs, a plurality of taps, a plurality of machine screw inserts, a machine mandrel, and an adhesive, wherein the toner cartridge comprises a cartridge shell and a plurality of screws, and wherein the cartridge shell comprises a plurality of screw holes;

B. removing the plurality of screws from the plurality of screw holes;

C. determining a compatible jig for the toner cartridge shell from the plurality of jigs;

D. inserting the toner cartridge shell into the compatible jig;

E. determining an at least one desired tap from the plurality of taps;

F. tapping the plurality of screw holes, wherein new threading is cut into each of the plurality of screw holes;

G. setting an insertion speed for rotation of the machine mandrel in a first direction, wherein the machine mandrel is spun in the first direction as the machine mandrel is lowered;

H. setting a removal speed for rotation of the machine mandrel in a second direction, wherein the machine mandrel is spun in the second direction as the machine mandrel is raised;

I. attaching a machine screw insert from the plurality of machine screw inserts onto the machine mandrel, wherein the machine screw insert corresponds to a specific hole from the plurality of holes;

J. applying the adhesive to the machine screw insert;

K. aligning the specific hole with the machine mandrel;

L. activating the machine mandrel, wherein the machine mandrel is lowered and raised in order to insert the machine screw insert into the specific hole;

M. repeating steps I, J, K, and L for each of the plurality of machine screw inserts; and N. inserting the plurality of screws into the plurality of screw holes, wherein the plurality of screws engages the plurality of machine screw inserts.

18. The method for remanufacturing toner cartridges as claimed in claim 17 further comprises the steps of:

providing the toner cartridge, wherein the toner cartridge further comprises internal components and a cover;

providing the plurality of screws, wherein the plurality of screws comprises a plurality of outer screws and a plurality of inner screws;

removing the plurality of outer screws from the plurality of screw holes;

removing the cover from the toner cartridge shell;

removing the plurality of inner screws from the plurality of screw holes; and removing the internal components from within the toner cartridge shell.

19. The method for remanufacturing toner cartridges as claimed in claim 17 further comprises the steps of:

providing the toner cartridge, wherein the toner cartridge further comprises internal components and a cover;

providing the plurality of screws, wherein the plurality of screws comprises a plurality of outer screws and a plurality of inner screws;

replacing the internal components within the toner cartridge shell;

inserting the plurality of inner screws into the plurality of screw holes, wherein the plurality of inner screws engages the plurality of machine screw inserts;

replacing the cover onto the toner cartridge shell; and inserting the plurality of outer screws into the plurality of screw holes, wherein the plurality of outer screws engages the plurality of machine screw inserts.

20. The method for remanufacturing toner cartridges as claimed in claim 17, wherein the insertion speed is less than 300 revolutions per minute and the removal speed is approximately half the insertion speed.

* * * * *